US006884974B2

(12) United States Patent
Howard et al.

(10) Patent No.: US 6,884,974 B2
(45) Date of Patent: Apr. 26, 2005

(54) MICA BOARD ELECTRICAL RESISTANCE WIRE HEATER, SUBASSEMBLIES, COMPONENTS, AND METHODS OF ASSEMBLY

(75) Inventors: H. Keith Howard, Cookeville, TN (US); Robert Kirby, Sparta, TN (US)

(73) Assignee: Tutco, Inc., Cookeville, TN (US)

( * ) Notice: Subject to any disclaimer, the term of this patent is extended or adjusted under 35 U.S.C. 154(b) by 0 days.

(21) Appl. No.: 10/392,879

(22) Filed: Mar. 21, 2003

(65) Prior Publication Data

US 2004/0182853 A1 Sep. 23, 2004

(51) Int. Cl.[7] ..... H05B 3/06; H05B 3/26

(52) U.S. Cl. ..... 219/536; 219/542; 219/532; 29/611; 439/733.1; 439/856

(58) Field of Search ..... 219/536, 542, 219/541, 532, 537, 538; 29/611; 439/856, 857, 733.1

(56) References Cited

U.S. PATENT DOCUMENTS 1,657,465 A * 1/1928 Forshee ..... 219/532
2,111,417 A * 3/1938 Bersted ..... 219/536
2,318,650 A * 5/1943 Penfold ..... 439/849
2,445,604 A * 7/1948 Clayton ..... 439/733.1
2,496,866 A * 2/1950 Flora ..... 439/857
3,691,348 A * 9/1972 Kunz ..... 219/532
3,978,653 A * 9/1976 Burke et al. ..... 439/856
4,163,146 A * 7/1979 Meywald ..... 219/542
4,730,377 A * 3/1988 Sherrill ..... 219/532
4,794,227 A * 12/1988 Antoniazzi et al. ..... 219/532
4,943,248 A * 7/1990 Colleran et al. ..... 439/857
5,112,235 A * 5/1992 Enomoto et al. ..... 439/857
5,925,273 A * 7/1999 Sherrill ..... 219/532
6,593,554 B1 * 7/2003 Danko et al. ..... 219/536

* cited by examiner

*Primary Examiner*—Teresa J. Walberg
(74) *Attorney, Agent, or Firm*—Clark & Brody

(57) ABSTRACT

A mica board open coil resistance heater assembly includes a mica board subassembly of at least one pair of mica boards, a resistance wire wound around the boards, an electrical connection clip secured to each mica board, wherein each end of the resistance wire is connected to a respective clip. A terminal plate subassembly includes a thermostat, a ceramic two-hole terminal block, and bus wires, the bus wires adapted to be attached to a portion of the electrical connection clip to connect the resistance wire to power. The ceramic two-hole terminal is able to receive push on terminals from power conductors.

22 Claims, 4 Drawing Sheets

MICA BOARD ELECTRICAL RESISTANCE WIRE HEATER, SUBASSEMBLIES, COMPONENTS, AND METHODS OF ASSEMBLY

FIELD OF THE INVENTION

The present invention is directed to a mica board electrical resistance wire heater, subassemblies, components, and methods of assembly, and in particular to the use of a clip on the mica boards to interconnect the resistance wire to power conductors and a ceramic terminal block that permits the use of push on terminals.

BACKGROUND ART

In the prior art, it is common to use plates, boards or sheets of various forms of mica in open air resistance heaters. Typically, a resistance wire is wrapped around the mica boards and mounted in a heater frame. The techniques used to wind the wire around the mica boards are well known, as is the technique for delivering power to the heating element terminals by a direct connection using insulated lead wires.

One problem with these types of mica board heaters is the number of manufacturing steps needed to make the heater. Presently, metal clips are first attached to the mica boards by riveting in a separate operation. Then, the resistance wire is wound around the mica board to form the subassembly of mica board and resistance wire. This operation is time consuming since a separate and distinct manufacturing step is required for attaching the clips to the mica boards.

Another problem with these types of heaters is the inability to use push on terminals for connection purposes. These heaters are designed with either mica terminal plates or metal terminal plates to electrically isolate energized wires and/or components. In either instance, electrical connection is accomplished by riveting terminals to the mica plate and the end of the resistance wire, which is a highly undesirable connection. Push on terminals cannot be used since mica is not strong enough to withstand the force required to properly connect a push on terminal.

Accordingly, a need exists to eliminate the weak and unreliable connections used in the prior art and extra manufacturing steps. The present invention responds to this need by providing a clip as part of a heater subassembly that removes the additional and separate step of riveting the clip to the mica board. The present invention also eliminates the need for riveting terminals to the mica board and ends of resistance wires. The present invention also provides a subassembly, which improves manufacturing by substituting welding for riveting when making electrical connections as part of a heater. The present invention also overcomes the inability to use push on terminals with mica board heaters.

SUMMARY OF THE INVENTION

A first object of the present invention is an improved electrical connection clip for mica board heater subassemblies.

Another object of the invention is a heater subassembly, which provides terminals for welding connections during heater assembly.

A still further object of the invention is a two-pole ceramic terminal block for a heater that permits push on terminal connections.

Yet another object of the invention is a method of heater assembly wherein heater subassemblies can be put together using automation.

Other objects and advantages of the present invention will become apparent as the description thereof proceeds.

In satisfaction of the foregoing objects and advantages, the present invention is an improvement in mica board open air resistance heaters. In one aspect, the invention provides a unique clip for attachment to a mica board and to facilitate electrical connection to ends of the resistance wire wrapped around the boards, as well as a heater subassembly combining the wire, mica boards, and clips.

The clip has a u-shaped body with first and second legs joined at one end to form a channel that is sized to capture a portion of the mica board. A first flange extends from an end of the first leg, the flange including a bendable tab at an end thereof. Bending of the tab towards the flange secures an end of the resistance wire to the clip. A second flange extends from an end of the second leg, the second flange being aligned generally with the first flange and forming a terminal for connection to a bus wire of a terminal plate subassembly. The clip can be retained via a spring bias of the legs or employ a tab extending from each leg forming the channel for engagement with the mica board. The tabs can interface with an opening in the mica board for retention purposes.

The subassembly of mica boards, resistance wire, and clips can be mounted to a frame for automated assembly with a terminal plate heater subassembly. A number of the subassemblies can be mounted between the frame plates depending on the desired heater capacity.

The invention also includes a heater assembly using the subassembly of the mica boards, the resistance wire, the clips, and the frame and another subassembly having a terminal plate with a terminal block and thermostat mounted thereon and being electrically connected together. The other subassembly has a first bus wire extending from one thermostat terminal and a second bus wire extending from one terminal of the terminal block. Each bus wire is electrically connected to a respective bus wire terminal so that power can be supplied to the resistance wire.

Another aspect of the invention is the use of a ceramic terminal block in the terminal plate subassembly. The terminal block is directly mounted to the metal terminal plate and employs a pair of block terminals adapted to received push on terminals of power conductors. This aspect of the invention also entails a method of connecting the electrical conductors to the terminals of a ceramic two-hole terminal block that is directly mounted to the metal terminal plate. The terminals of the pair of power conductor terminals are pushed onto the block terminals without damage to the block or terminal plate.

Another method aspect of the invention involves an improvement in electrically connecting the electrical resistance wire wound around the pair of mica boards. In this method, the electrical connection clip is clipped onto one end of each of the mica boards and each end of the resistance wire that is wrapped around the mica board pair is secured to a respective flange of each of the electrical connection clips. The thus assembled mica boards, resistance wires and clips are then mounted to the frame to form the mica board subassembly. This subassembly is aligned with the terminal plate subassembly and the bus wires thereof are welded to the bus wire terminals so that electrical power can be supplied to the electrical resistance wire.

BRIEF DESCRIPTION OF THE DRAWINGS

Reference is now made to the drawings of the invention wherein.

DESCRIPTION OF THE PREFERRED EMBODIMENTS

Figure 1:
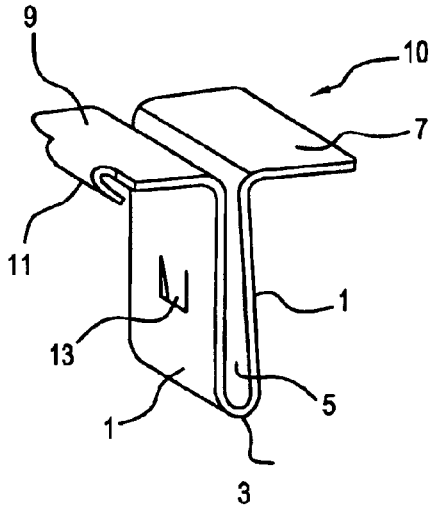
FIG. 1 is a perspective view of an electrical connection clip of the invention.
Figure 2:
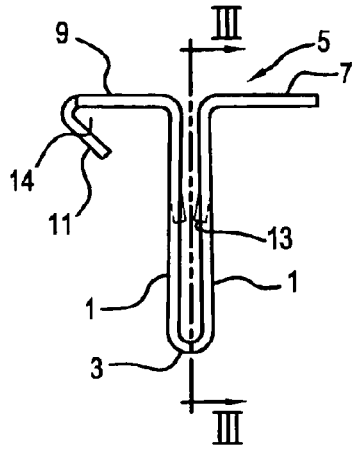
FIG. 2 is a side view of the clip of FIG. 1.
Figure 3:
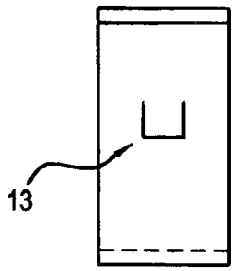
FIG. 3 is a view along the line III—III of FIG. 2.

Referring now to FIGS. 1–3, a clip for making an electrical connection with the resistance wire of a mica board heater is designated by the reference numeral 10. The clip 10 has a pair of legs 1, which are joined at 3 to form a u-shape. The legs 1 have a spring bias inward and form a channel 5, which is sized to receive or capture a mica board that is part of the heater as will be shown later.

One leg of the clip terminates in a flange 7 with the other leg of the clip terminating in a flange 9. The flange 9 includes a bendable tab 11 on an end thereof. Each leg also has a second tab 13, which extends into the channel 5 and helps retain the mica board in place with the bias of the clip legs pressing against the mica board sides.

The bendable tab 11 and flange 9 form a space 14 which is designed to receive a part of the end of the resistance wire that is wound around the mica board. The flange 7 is designed to receive a bus wire to electrically interconnect the resistance wire to power.

Figure 4:
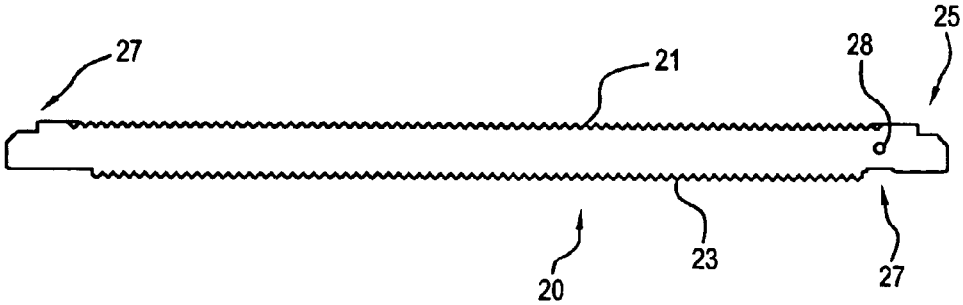
FIG. 4 is a side view of a mica board for use with the clip of FIG. 1.
Figure 5:
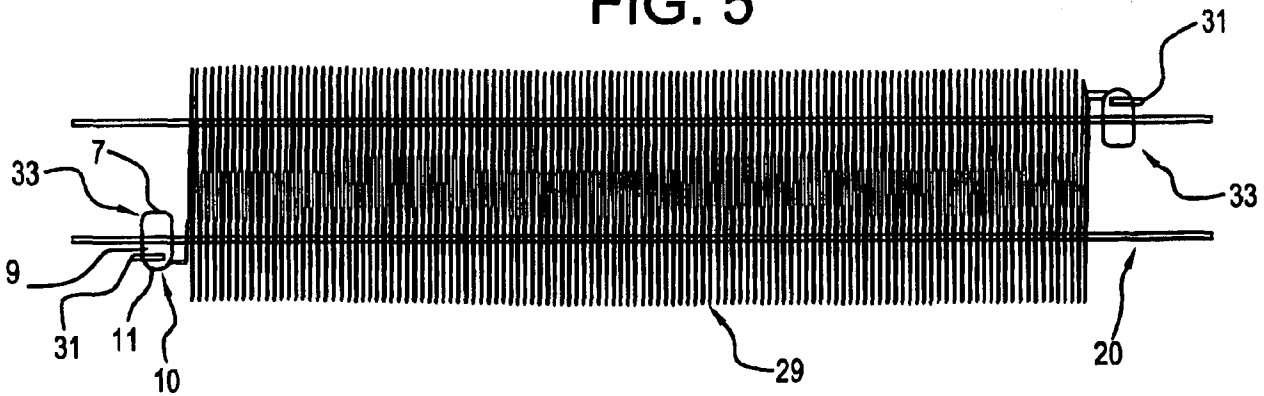
FIG. 5 is a top view of a first heater subassembly of the invention.
Figure 7:
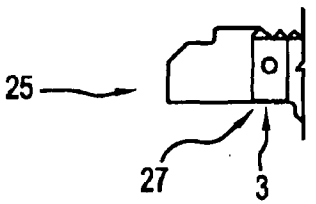
FIG. 7 is a side view detail of the clip attached to an end of the mica board of FIG. 4.
Figure 6:
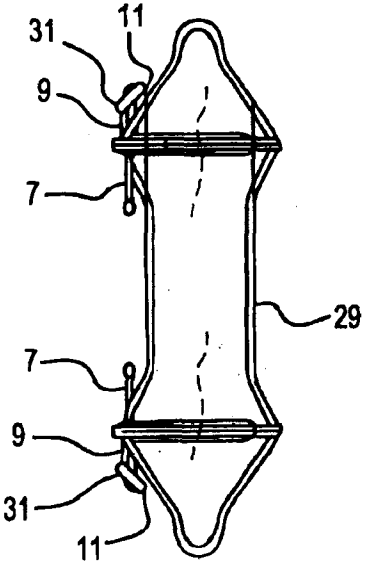
FIG. 6 is an end view of the subassembly of FIG. 5 enlarged to show greater detail.

Referring now to FIG. 4, an exemplary mica board is designated by the reference numeral 20 and has a number of grooves 21 and 23 disposed on edges of the board. The grooves 21 and 23 receive the resistance wire windings and maintain the proper spacing between the wires. The ends 25 and 27 of the mica board are configured to connect to an opening in a heater frame component as detailed below. One end 25 is also configured to receive the clip 10 by the presence of a recess 27, which engages the junction 3 of the clip. The mica board end 25 also has an opening 28 which is sized and located to interface with the tabs 13 to keep the clip 10 in place.

Referring now to FIGS. 4–7, a pair of mica boards 20 are shown with a resistance wire 29 wrapped therearound. A clip 10 is mounted at each end 25 of the board, with each end 31 of the wire 29 crimped between the flange 9 and bendable tab 11 of each clip 10. The flange 7 forms a terminal 33, which permits making electrical connection between the ends 31 of the resistance wire 29 and a bus bar or jumper wire of the heater, as described below. Although not shown, the flange 9 is preferably bent downward and toward the junction 3 of the clip 10 so that the wire end 31 that is curled over the flange 9 does not interfere with a subsequent attachment of the flange 7 to the bus wire. The combination of the mica boards 20, the wire 29 and the clips 10 forms a subassembly 30, which can be further used to make the mica heater.

The clip 10 is advantageous in its ability to make an electrical connection or termination of the ends 31 of the wire 29 without the need for a riveting operation to attach the clip to the mica board. The clip design and presence of the flanges 7 and 9 is particularly beneficial by forming surfaces which allows for attachment to the resistance wire end and a welded connection to a bus wire, thus permitting the connection with the bus or jumper wire of another frame subassembly to be easily automated.

Figure 8:
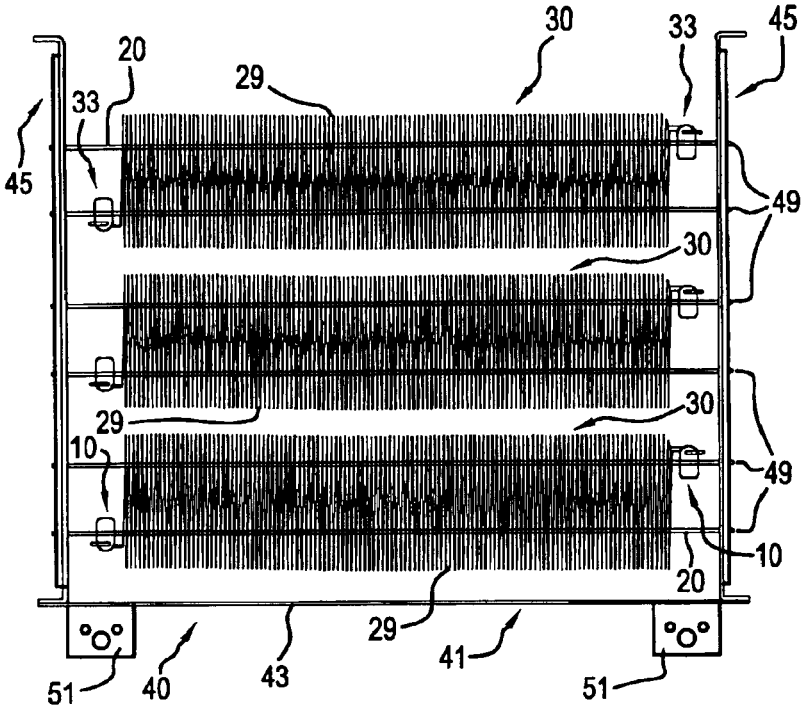
FIG. 8 is a top view of a second heater subassembly of the invention.
Figure 9:
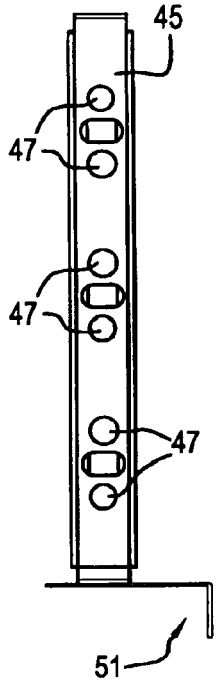
FIG. 9 is a side view of the subassembly of FIG. 8.

FIGS. 8 and 9 show a second heater subassembly 40 wherein a number of subassemblies 30 are mounted in a frame 41. The frame 41 comprises an end plate 43, and a pair of side plates 45. Each side plate 45 has openings 47, which are sized to receive ends 49 of the mica boards 20. The plates 43 and 45 can be connected in any fashion but are preferably welded together. The end plate 43 includes a pair of mounting flanges 51 for heater attachment purposes in the environment of use.

Figure 10:
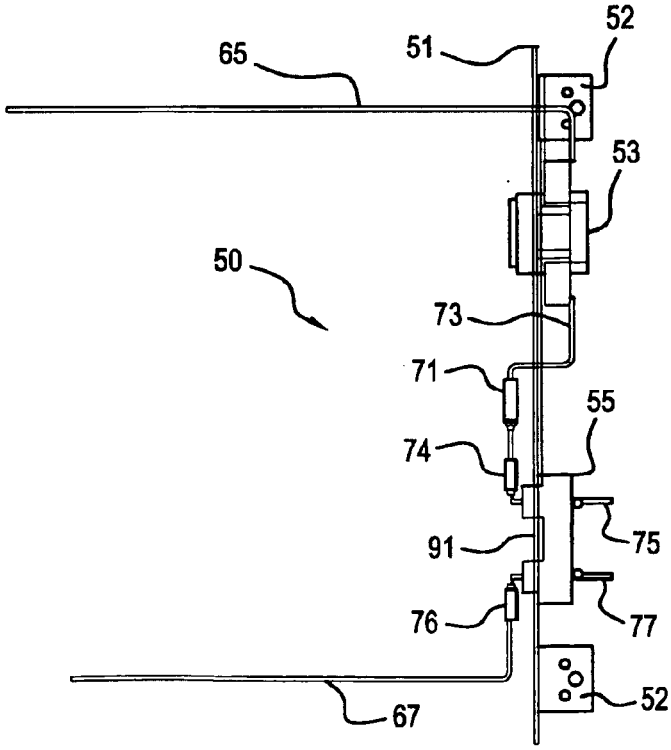
FIG. 10 is a top view of a third heater subassembly.
Figure 11:
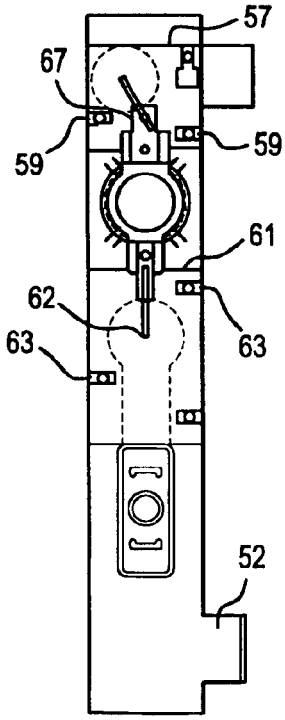
FIG. 11 is a side view of the subassembly of FIG. 10.

As is apparent from FIG. 8, the terminals 33, as formed by the flange 7 of each clip 10, are aligned along each side plate 45 to facilitate the automated assembly of the heater with another subassembly 50 as shown in FIGS. 10 and 11.

The subassembly 50 includes a metal terminal plate 51, which has mounted thereon, a thermostat 53, and a terminal block 55. The plate 51 also has flanges 52, similar to those in the subassembly 40 for heater attachment purposes. Referring to FIG. 11, a first mica insulator plate 57 is mounted on the metal plate 51 and is held in place by fold over tabs 59. The tabs 59 are formed by punching out the tab from the plate 51, but other attachment techniques could be used to secure the plate 57 in place. A second mica insulator 61 is also mounted on the metal plate 51 and held in place with tabs 63. The mica plates 57 and 61 isolate the energized wires and/or other components of the heater.

The subassembly 50 also includes a pair of bus or jumper wires 65 and 67. Wire 65 passes through a hole in the mica plate 57 and is welded to a terminal 69 of the thermostat 53. The wire 65 extends beyond the plate 51 in a generally perpendicular direction with respect to the plate 51, and is intended to make an electrical connection with the terminals formed by the flanges 7.

Continuing to refer to FIGS. 8 and 9, a temperature sensing fuse 71 is provided, one end passing through an opening 62 in the plate 61 and being welded to the other terminal 73 of the thermostat 53. The other lead of the fuse 71 is attached to one end 74 of a terminal 75 passing through one hole of the terminal block 55. The terminal 75 is intended to accept a push on terminal attached to the end of the first of two electrical power conductors.

The other bus wire 67 has one end attached to an end 76 of the second terminal 77 in the block 55. As with the first terminal 75, the second terminal 77 is also designed to accept a push on terminal attached to the end of the second of the two electrical power conductors. The bus wire 67 then extends in a direction similar to bus wire 65 for attachment to clips 10 of the subassembly 40.

Figure 12:
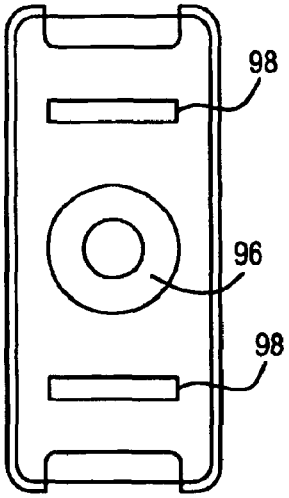
FIG. 12 is a top view of a terminal block of the invention.
Figure 13:
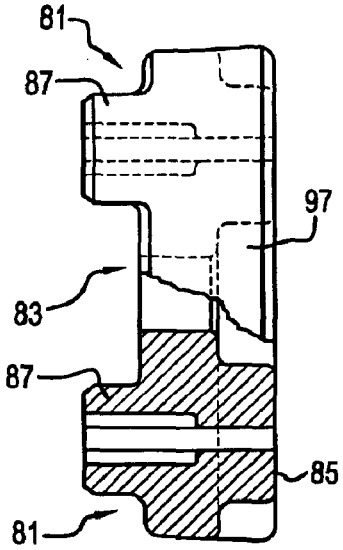
FIG. 13 is a partial side and partial cross section view of the block of FIG. 12.
Figure 14:
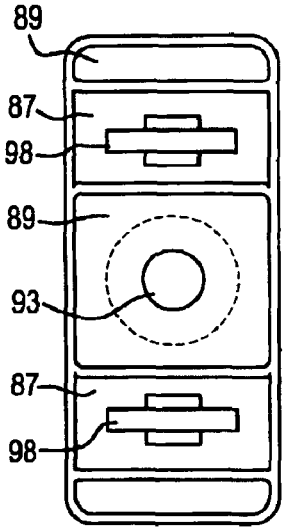
FIG. 14 is a bottom view of the block of FIG. 12.

The terminal block 55 is shown in more detail in FIGS. 12–14. The block is made of a ceramic material and has terminal hole portions 81, which are interconnected by middle portion 83. The terminal hole portions 81 and middle portion 83 form a flat face 85 serving as a bottom of the block 55. Opposite ends of the hole portions 81 are stepped to form-rectangular protrusions 87 extending from surface 89. The protrusions 87 extend through a pair of openings (not shown) in the metal plate 51 with the surfaces 89 abutting the plate when the block is attached thereto, see FIG. 10. The fastening of the block 55 occurs by the use of a rivet 91 and a stepped throughhole 93 in the middle portion 83, see FIG. 10. The rivet extends through hole 93 and engages the plate 51 and the face 96 in the recess 97 to secure the block in place. Each hole portion 81 has an opening 98 which is configured to receive and retain the terminals 75 and 77.

The use of the ceramic two hole block in combination with the metal plate 51 allows the use of push on terminals to connect the power conductors to the terminals 75 and 77. The ceramic block backed up by the metal plate 51 is capable of withstanding the force applied during automated push on terminal connection. This contrasts with the thin gauge mica plates 57 and 61 and metal plate 51, the combination thereof not capable of withstanding such a force application.

Figure 15:
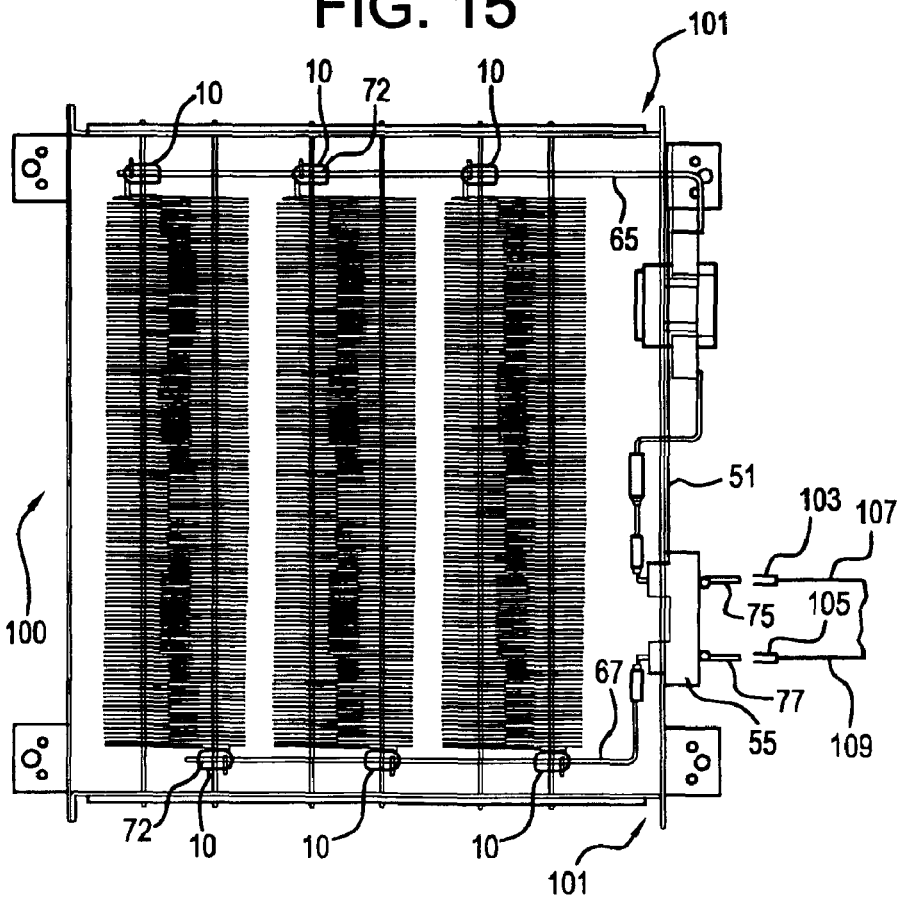
FIG. 15 is a top view of a heater of the present invention incorporating the subassembly of FIGS. 8 and 10.

FIG. 15 shows an assembled heater 100 wherein the heater subassembly 40 is combined with the heater subassembly 50. In assembling the heater, it can be seen that the bus wires align with respective sets of the clips 10 so that the connection between the bus wires and clips 10 can be easily made by welding. As part of the assembly 100, ends of the frame plates 45 of the subassembly 40 are welded to the terminal plate 51 at 101. The presence of the flanges 7 on the clips provides a ready surface for the welded connection to the bus wires 65 and 67. Further, the clip design allows the assemblies to be put together using an automated process, and manufacturing speed is greatly increased. The prior art step whereby the clips are attached using a separate process is eliminated; the clip attachment and welding operation can be done as part of one sequence.

FIG. 15 also shows a pair of push on terminals 103 and 105 connected at the ends of power conductors 107 and 109. These terminals are pushed onto the terminals 75 and 77 of the terminal block 55 as a result of the ceramic nature of the block 55 and its capability of withstanding the push on force from the terminals 103 and 105.

The inventive clip also provides for improvements in the method of assembling the various heater subassemblies. The clip 10 can be merely slid onto the mica board 20 and retained by spring bias or, if present in the clips 10 and boards 20, the tabs 13 and openings 28 can be used as described above. This operation can be done in the same venue as the winding of the resistance wires on the mica boards, and the extra and separate riveting step mandated in the prior art is eliminated. Once the clip 10, wire 29, and mica boards 20 are assembled, this subassembly 30 can be mounted in the frame plates as shown in FIG. 8 to form the subassembly 40. As an alternative, the clips 10 can be attached after winding of the wires on the mica boards, and this step can be performed during the final assembly stage of the heater or as part of other steps of assembly following the winding step. It should also be understood that the flange 9 could be used as a terminal for welding with the bus wire if so desired, although it is preferred that flange 7 be used since the resistance wire is not present and welding is less complicated.

The subassembly 40 is then mated with the subassembly 50 so that the bus wires 65 and 67 can be welded to the terminal flanges 7 at 72, and the ends of the frame plates 45 can be secured to the terminal plate 51. The entire assembly can then be mounted in the desired location for heating; the power conductors can be pushed onto the terminals 75 and 77 at the appropriate time. Linking the subassemblies together can be done using automation whereby the various components are positioned to have such steps as welding done automatically so that the manufacturing process is low cost and quick.

It should be understood that the invention described above is one embodiment, but other variations may be made without departing from the scope of the invention. For example, while the tab 13 is shown as part of the clip 10, and the mica board is provided with a corresponding opening 28, it is believed that the tab 13/opening 28 could be eliminated in situations wherein the bias of the clip would be sufficient to hold the clip in place. Alternatively, another type of engaging protrusion could be fashioned as part of the clip to retain it in place on the mica board 20.

Although FIG. 8 shows a number of subassemblies 30 arranged between the frame plates 45, one, two, or more than three subassemblies can be linked together. Further, a number of the subassemblies 40 could be combined as one heater apparatus. The assembled heater can be used in any apparatus or device that requires these types of heaters.

As such, an invention has been disclosed in terms of preferred embodiments thereof which fulfills each and every one of the objects of the present invention as set forth above and provides a new and improved mica board open air electric resistance heater, and subassemblies and components thereof, and methods of assembly.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. An electrical connection clip for securing ends of a resistance wire wound on a mica board comprising:

a) a u-shaped clip body having first and second legs joined at one end to form a channel sized to capture a portion of the mica board, b) a first flange extending from an end of the first leg, the flange including a bendable tab at an end thereof, bending of the tab towards the flange securing an end of the resistance wire to the clip; and c) a second flange extending from an end of the second leg, the second flange aligned generally with the first flange and having a size matching the first flange, the size of the second flange being of sufficient area to form a terminal for connection to a bus wire of a heater assembly using one or more resistance wire-containing mica boards.

2. The clip of claim 1, wherein each leg has a capture tab extending from a surface forming the channel for the capture.

3. In a resistance wire heater subassembly comprising a pair of mica boards and a resistance wire wound around the pair of mica boards, the improvement comprising a pair of the electrical connection clips, each electrical connection clip further comprising:

a) a u-shaped clip body having first and second legs joined at one end to form a channel sized to capture a portion of the mica board;

b) a first flange extending from an end of the first leg, the flange including a bendable tab at an end thereof, bending of the tab towards the flange securing an end of the resistance wire to the clip; and c) a second flange extending from an end of the second leg, the second flange aligned generally with the first flange to form a terminal for connection to a bus wire of a heater assembly using one or more resistance wire-containing mica boards;

wherein each clip is clipped onto an end of one of the mica boards, and each end of the resistance wire is secured between the tab and first flange of a respective electrical connection clip.

4. The resistance wire heater subassembly of claim 3, wherein each leg has a capture tab extending from a surface forming the channel, each tab engaging a portion of the mica board when positioned in the channel.

5. The resistance wire heater subassembly of claim 4, wherein each mica board has an opening to receive the capture tab of a respective electrical connection clip.

6. The resistance wire subassembly of claim 3, wherein the resistance wire heater subassembly is mounted to a frame for automated assembly with a terminal plate heater subassembly.

7. The subassembly of claim 6, comprising a plurality of resistance wire heater subassemblies, each of the resistance wire heater subassemblies mounted to the frame to form a pair of aligned clip sets for automated assembly with a terminal plate heater subassembly.

8. A heater assembly comprising:

a) a first heater subassembly comprising a resistance wire wound around the pair of mica boards, and a pair of the electrical connection clips, wherein each clip is clipped onto an end of one of the mica boards, and each end of the resistance wire is secured to a flange of the electrical connection clip, the clip including a bus wire terminal and the mica boards mounted to a frame; and b) a second heater subassembly having a terminal plate with a terminal block and thermostat mounted thereon and being electrically connected together, a first bus wire extending from one thermostat terminal, and a second bus wire extending from one terminal of the terminal block;

c) wherein each bus wire is electrically connected to a respective bus wire terminal so that power can be supplied to the resistance wire.

9. The heater of claim 8, comprising a plurality of first heater subassemblies, each mounted to the frame to form opposed sets of aligned bus wire terminals, each bus wire aligned and electrically connected with one of the set of aligned bus wire terminals.

10. In an open air resistance heater using at least a pair of mica boards with a resistance wire wrapped around the board, the improvement comprising a pair of mica boards clips, each mica board clip clipped onto an end of each mica board, each end of the resistance wire attached to a flange of each mica board clips, the clip including a bus wire terminal adapted to connect with a bus wire to complete an electrical connection for the heater.

11. A heater comprising:

a mica board open coil heater mounted to a metal terminal plate and a ceramic two hole terminal block directly mounted to the metal terminal plate and having a pair of block terminals adapted to receive push on terminals of power conductors to provide power to the open coil heater.

12. The heater of claim 11, wherein the mica board open coil heater has a run of heating resistance wire coiled around at least one mica board with the mica board passing through the coil.

13. A method of connecting electrical conductors to terminals of a mica board open coil heater comprising:

mounting a mica board open coil heater to a metal terminal plate, providing a ceramic two hole terminal block directly mounted to the metal terminal plate with a pair of block terminals, and pushing a pair of power conductor terminals onto the block terminals to provide power to the open coil heater.

14. The method of claim 13, wherein the mica board open coil heater has a run of heating resistance wire coiled around at least one mica board with the mica board passing through the coil.

15. In method of making a mica board electrical resistance heater subassembly including the steps of mounting a clip on an end of each mica board and winding an electrical resistance wire around the pair of mica boards, the improvement comprising:

a) clipping an electrical connection clip onto one end of each of the mica boards, the electrical connection clip having a flange and adapted to connect to a bus wire to supply power to the resistance wire; and b) securing each end of the resistance wire wrapped around the mica board pair to a respective flange of each of the electrical connection clips.

16. The method of claim 15, further comprising mounting the mica board electrical resistance heater subassembly to a frame.

17. The method of claim 16, further comprising welding a bus wire of a terminal plate heater subassembly to each bus wire terminal so that electrical power can be supplied to the electrical resistance wire.

18. The method of claim 15, wherein the electrical connection clip further comprises:

a) a u-shaped clip body having first and second legs joined at one end to form a channel to capture a portion of the mica board, b) the first flange extending from an end of the first leg, the flange including a bendable tab at an end thereof, bending of the tab towards the flange securing an end of the resistance wire to the clip; and c) a second flange extending from an end of the second leg for connecting to a bus wire.

19. The method of claim 15, further comprising using a plurality of mica board pairs for the clipping and securing steps.

20. The method of claim 15, wherein the electrical connection clip includes a pair of capture tabs extending therefrom, and each mica board has an opening sized to engage the capture tabs of a respective electrical connection clip, and the clipping step for each electrical connection clip includes engaging the opening in the mica board using the tabs.

21. The method of claim 18, further comprising mounting the mica board electrical resistance heater subassembly to a frame.

22. The method of claim 21, further comprising welding a bus wire of a terminal plate heater subassembly to each second flange so that electrical power can be supplied to the electrical resistance wire.

* * * * *